US008743104B2

(12) United States Patent
Tsai et al.

(10) Patent No.: US 8,743,104 B2
(45) Date of Patent: Jun. 3, 2014

(54) ORGANIC LIGHT EMITTING DISPLAY HAVING PIXEL DATA SELF-RETAINING FUNCTIONALITY

(75) Inventors: Tsung-Ting Tsai, Hsin-Chu (TW); Yuan-Chun Wu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 1065 days.

(21) Appl. No.: 12/773,020

(22) Filed: May 4, 2010

(65) Prior Publication Data

US 2011/0148840 A1 Jun. 23, 2011

(30) Foreign Application Priority Data

Dec. 17, 2009 (TW) ..... 98143340 A

(51) Int. Cl.
*G06F 3/038* (2013.01)
*G09G 5/00* (2006.01)

(52) U.S. Cl.
USPC ..... 345/211

(58) Field of Classification Search
USPC ..... 345/690, 211
See application file for complete search history.

(56) References Cited

U.S. PATENT DOCUMENTS

| | | | | |
|---|---|---|---|---|
| 7,116,292 | B2 | 10/2006 | Ozawa | |
| 2003/0058200 | A1 * | 3/2003 | Numao | 345/76 |
| 2005/0151706 | A1 | 7/2005 | Lifka | |
| 2006/0244689 | A1 | 11/2006 | Osame | |

FOREIGN PATENT DOCUMENTS

| | | | |
|---|---|---|---|
| CN | 1345023 | A | 4/2002 |
| CN | 101581862 | A | 11/2009 |

* cited by examiner

*Primary Examiner* — Quan-Zhen Wang
*Assistant Examiner* — Nelson D Runkle, III
(74) *Attorney, Agent, or Firm* — Winston Hsu; Scott Margo

(57) ABSTRACT

An organic light emitting display includes a current driving unit, an organic light emitting diode and a memory unit. The current driving unit is employed to provide a driving current according to a driving voltage generated therein. The organic light emitting diode generates a light output based on the driving current. The operation of the memory unit is controlled by a first auxiliary power voltage and a second auxiliary power voltage. When the first auxiliary power voltage is greater than the second auxiliary power voltage, the memory unit is enabled to perform a voltage retaining operation on the driving voltage. When the second auxiliary power voltage is greater than the first auxiliary power voltage, the memory unit is disabled for ceasing the voltage retaining operation.

19 Claims, 10 Drawing Sheets

ORGANIC LIGHT EMITTING DISPLAY HAVING PIXEL DATA SELF-RETAINING FUNCTIONALITY

BACKGROUND OF THE INVENTION

1. Field of the Invention

The present invention relates to an organic light emitting display, and more particularly, to an organic light emitting display having pixel data self-retaining functionality.

2. Description of the Prior Art

Because flat panel displays (FPDs) have advantages of thin appearance, low power consumption, and low radiation, various kinds of flat panel displays have been developed and widely applied in a variety of electronic products such as computer monitors, mobile phones, personal digital assistants (PDAs), or flat panel televisions. Among them, active matrix organic light emitting displays (AMOLEDs) have gained more and more attention due to further advantages of self-emitting light source, high brightness, high emission rate, high contrast, fast reaction, wide viewing angle, and extensive range of working temperature.

FIG. 1 is a structural diagram schematically showing a prior-art active matrix organic light emitting display 100. As shown in FIG. 1, the active matrix organic light emitting display 100 comprises a gate driving circuit 110, a data driving circuit 120, a plurality of pixel circuits 140, and a power unit 190. Each pixel circuit 140 includes a first transistor 141, a second transistor 142, a storage capacitor 143, and an organic light emitting diode 144. The power unit 190 is employed to provide a high power voltage Vdd and a low power voltage Vss which are furnished to each pixel circuit 140. The gate driving circuit 110 and the data driving circuit 120 are utilized for providing plural gate signals and plural data signals respectively. Each pixel circuit 140 employs corresponding gate and data signals to control the light-emitting driving operation of one organic light emitting diode 144 based on the voltage difference between the high power voltage Vdd and the low power voltage Vss. However, while the active matrix organic light emitting display 100 is displaying a still frame, the gate driving circuit 110 and the data driving circuit 120 still continue to provide the gate and data signals for periodically performing writing operations on the pixel circuits 140. And therefore the power consumption of displaying a still frame is substantially equal to that of displaying motion frames.

SUMMARY OF THE INVENTION

In accordance with one embodiment of the present invention, an organic light emitting display having pixel data self-retaining functionality is disclosed. The organic light emitting display comprises a gate driving circuit for providing a gate signal, a data driving circuit for providing a data signal, a gate line, a data line, a current driving unit, an organic light emitting diode, a memory unit, and a voltage providing module.

The gate line, electrically connected to the gate driving circuit, is employed to deliver the gate signal. The data line, electrically connected to the data driving circuit, is employed to deliver the data signal. The current driving unit, electrically connected to the gate line and the data line, is utilized for generating a driving voltage according to the gate signal and the data signal, and for providing a driving current according to the driving voltage and a high power voltage. The organic light emitting diode, electrically connected to the current driving unit, is utilized for generating a light output according to the driving current. The memory unit, electrically connected to the current driving unit, is utilized for performing a voltage retaining operation on the driving voltage according to a first auxiliary power voltage and a second auxiliary power voltage. The voltage providing module, electrically connected to the current driving unit and the memory unit, is employed to provide the high power voltage, the first auxiliary power voltage and the second auxiliary power voltage. In the operation of the organic light emitting display, when the first auxiliary power voltage is a high auxiliary power voltage and the second auxiliary power voltage is a low auxiliary power voltage, the memory unit is enabled to perform the voltage retaining operation. Alternatively, when the first auxiliary power voltage is the low auxiliary power voltage and the second auxiliary power voltage is the high auxiliary power voltage, the memory unit is disabled for ceasing the voltage retaining operation.

In accordance with another embodiment of the present invention, an organic light emitting display having pixel data self-retaining functionality is disclosed. The organic light emitting display comprises a gate driving circuit for providing a gate signal, a data driving circuit for providing a data signal, a gate line, a data line, a current driving unit, an organic light emitting diode, a first inverter, a second inverter, and a voltage providing module.

The gate line, electrically connected to the gate driving circuit, is employed to deliver the gate signal. The data line, electrically connected to the data driving circuit, is employed to deliver the data signal. The current driving unit, electrically connected to the gate line and the data line, is utilized for generating a driving voltage according to the gate signal and the data signal, and for providing a driving current according to the driving voltage and a high power voltage. The organic light emitting diode, electrically connected to the current driving unit, is utilized for generating a light output according to the driving current. The first inverter comprises an input end electrically connected to the current driving unit for receiving the driving voltage, a first power end for receiving a first auxiliary power voltage, a second power end for receiving a second auxiliary power voltage, and an output end electrically connected to the second inverter. The second inverter comprises an input end electrically connected to the output end of the first inverter, a first power end for receiving the first auxiliary power voltage, a second power end for receiving the second auxiliary power voltage, and an output end electrically connected to the input end of the first inverter. The voltage providing module, electrically connected to the current driving unit, the first inverter and the second inverter, is employed to provide the high power voltage, the first auxiliary power voltage and the second auxiliary power voltage. In the operation of the organic light emitting display, when the first auxiliary power voltage is a high auxiliary power voltage and the second auxiliary power voltage is a low auxiliary power voltage, the first and second inverters are enabled to perform a voltage retaining operation on the driving voltage. Alternatively, when the first auxiliary power voltage is the low auxiliary power voltage and the second auxiliary power voltage is the high auxiliary power voltage, the first and second inverters are disabled for ceasing the voltage retaining operation.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto.

Figure 1:
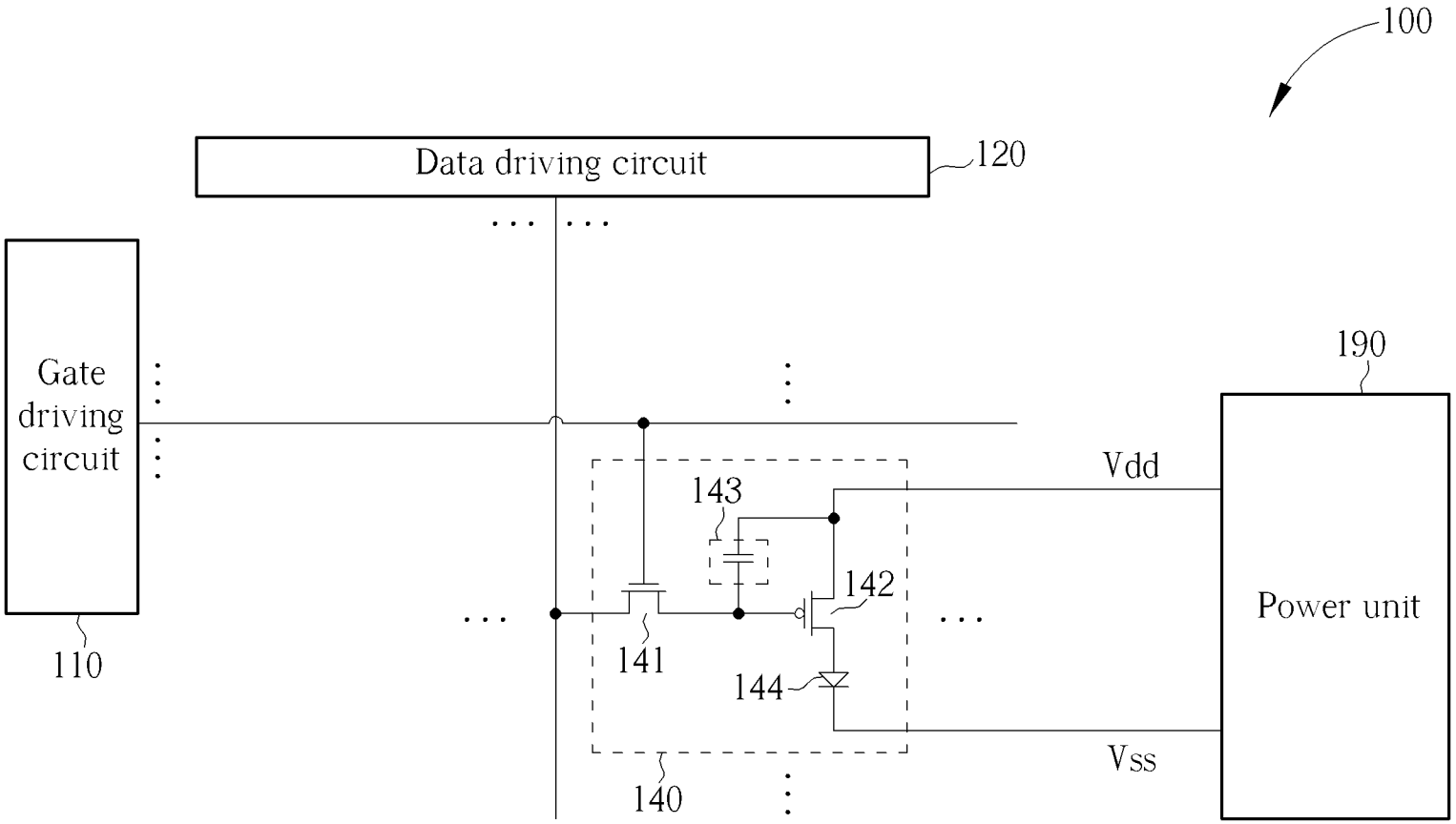
FIG. 1 PRIOR ART
FIG. 1 is a structural diagram schematically showing a prior-art active matrix organic light emitting display.
Figure 2:
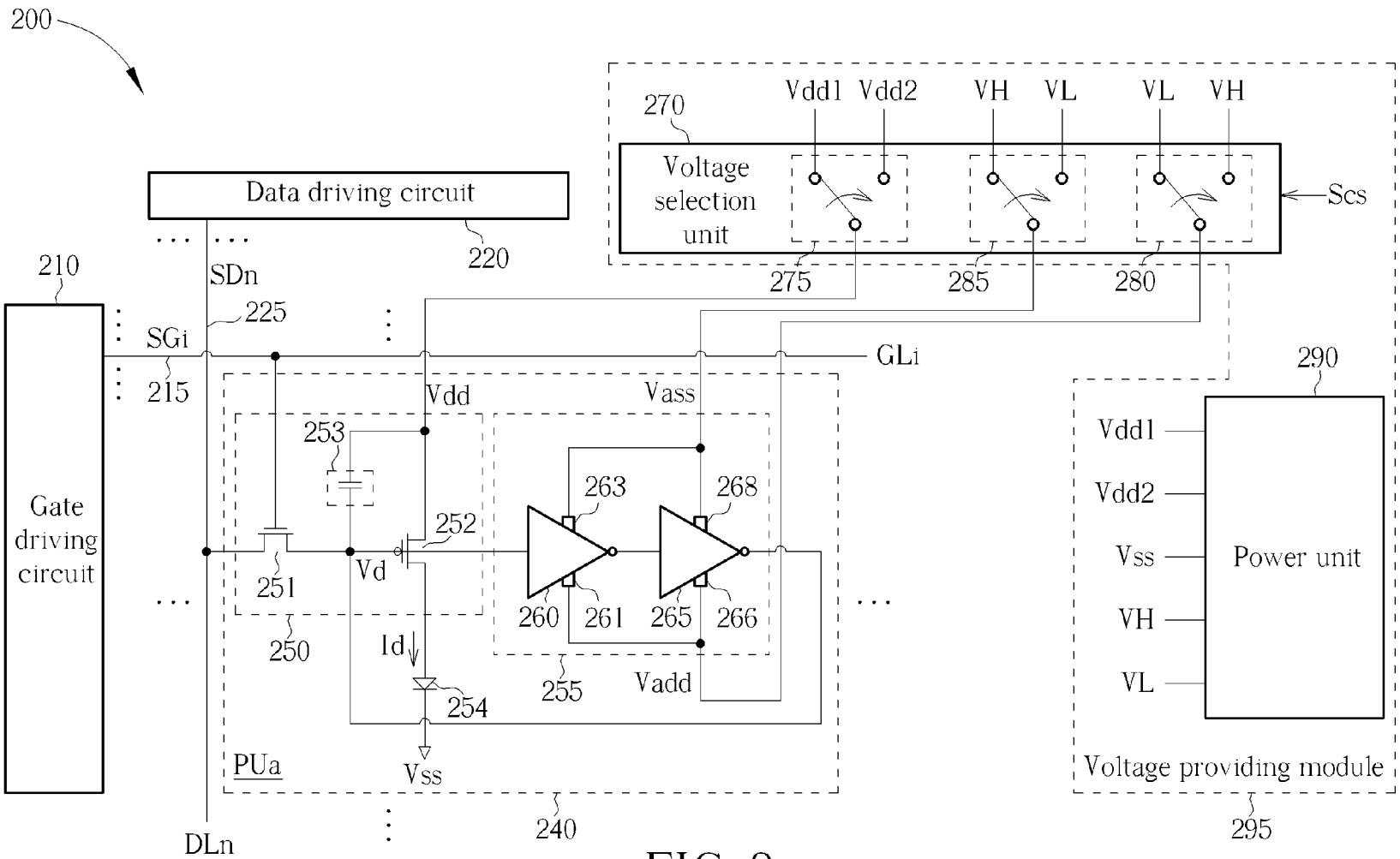
FIG. 2 is a schematic diagram showing the structure of an organic light emitting display in accordance with a first embodiment of the present invention.

FIG. 2 is a schematic diagram showing the structure of an organic light emitting display 200 in accordance with a first embodiment of the present invention. As shown in FIG. 2, the organic light emitting display 200 comprises a gate driving circuit 210, a data driving circuit 220, a plurality of gate lines 215, a plurality of data lines 225, a plurality of pixel circuits 240 and a voltage providing module 295. For ease of explanation, the organic light emitting display 200 illustrates a gate line GLi of the gate lines 215, a data line DLn of the data lines 225, and a pixel circuit PUa of the pixel circuits 240. The gate line GLi, electrically connected to the gate driving circuit 210, functions to deliver a gate signal SGi provided by the gate driving circuit 210. The data line DLn, electrically connected to the data driving circuit 220, functions to deliver a data signal SDn provided by the data driving circuit 220. The pixel circuit PUa comprises a current driving unit 250, a memory unit 255 and an organic light emitting diode 254. The voltage providing module 295 comprises a power unit 290 and a voltage selection unit 270.

The current driving unit 250, electrically connected to the gate line GLi and the data line DLn, is utilized for generating a driving voltage Vd according to the gate signal SGi and the data signal SDn, and further for providing a driving current Id according to the driving voltage Vd, a high power voltage Vdd and a low power voltage Vss. The organic light emitting diode 254 comprises an anode electrically connected to the current driving unit 250 and a cathode for receiving the low power voltage Vss. The organic light emitting diode 254 is employed to generate a light output based on the driving current Id. The memory unit 255, electrically connected to the current driving unit 250, is utilized for performing a voltage retaining operation on the driving voltage Vd according to a first auxiliary power voltage Vadd and a second auxiliary power voltage Vass.

The power unit 290 is employed to provide a first high power voltage Vdd1, a second high power voltage Vdd2 less than the first high power voltage Vdd1, a high auxiliary power voltage VH, a low auxiliary power voltage VL and the low power voltage Vss. The voltage selection unit 270, electrically connected to the current driving unit 250 and the memory unit 255, is utilized for selecting either the first high power voltage Vdd1 or the second high power voltage Vdd2 to become the high power voltage Vdd, for selecting either the high auxiliary power voltage VH or the low auxiliary power voltage VL to become the first auxiliary power voltage Vadd, and further for selecting either the low auxiliary power voltage VL or the high auxiliary power voltage VH to become the second auxiliary power voltage Vass. When the first auxiliary power voltage Vadd is the high auxiliary power voltage VH and the second auxiliary power voltage Vass is the low auxiliary power voltage VL, the memory unit 255 is enabled to perform the voltage retaining operation. When the first auxiliary power voltage Vadd is the low auxiliary power voltage VL and the second auxiliary power voltage Vass is the high auxiliary power voltage VH, the memory unit 255 is disabled for ceasing the voltage retaining operation.

In the embodiment shown in FIG. 2, the current driving unit 250 comprises a first transistor 251, a second transistor 252 and a storage capacitor 253, the memory unit 255 comprises a first inverter 260 and a second inverter 265, and the voltage selection unit 270 comprises a first voltage selector 275, a second voltage selector 280 and a third voltage selector 285. The first transistor 251 comprises a first end electrically connected to the data line DLn for receiving the data signal SDn, a second end electrically connected to the memory unit 255, and a gate end electrically connected to the gate line GLi for receiving the gate signal SGi. The first transistor 251 can be a P-type thin film transistor or an N-type thin film transistor. The second transistor 252 comprises a first end electrically connected to the first voltage selector 275 for receiving the high power voltage Vdd, a second end electrically connected to the anode of the organic light emitting diode 254, and a gate end electrically connected to the second end of the first transistor 251. The second transistor 252 can be a P-type thin film transistor. The storage capacitor 253, electrically connected between the gate and first ends of the second transistor 252, is utilized for storing the driving voltage Vd.

The first inverter 260 comprises an input end electrically connected to the second end of the first transistor 251 for receiving the driving voltage Vd, a first power end 261 electrically connected to the second voltage selector 280 for receiving the first auxiliary power voltage Vadd, a second power end 263 electrically connected to the third voltage selector 285 for receiving the second auxiliary power voltage Vass, and an output end. The second inverter 265 comprises an input end electrically connected to the output end of the first inverter 260, a first power end 266 electrically connected to the second voltage selector 280 for receiving the first auxiliary power voltage Vadd, a second power end 268 electrically connected to the third voltage selector 285 for receiving the second auxiliary power voltage Vass, and an output end electrically connected to the input end of the first inverter 260.

The first voltage selector 275, electrically connected to the power unit 290 and the current driving unit 250, is utilized for selecting either the first high power voltage Vdd1 or the second high power voltage Vdd2 to become the high power voltage Vdd according to a selection control signal Scs. The second voltage selector 280, electrically connected to the power unit 290, the first power end 261 and the first power end 266, is utilized for selecting either the high auxiliary power voltage VH or the low auxiliary power voltage VL to become the first auxiliary power voltage Vadd according to the selection control signal Scs. The third voltage selector 285, electrically connected to the power unit 290, the second power end 263 and the second power end 268, is utilized for selecting either the low auxiliary power voltage VL or the high auxiliary power voltage VH to become the second auxiliary power voltage Vass according to the selection control signal Scs. In another embodiment, the voltage selection operations of the first voltage selector 275, the second voltage selector 280 and the third voltage selector 285 can be performed based on different selection control signals. When the first auxiliary power voltage Vadd is the high auxiliary power voltage VH and the second auxiliary power voltage Vass is the low auxiliary power voltage VL, the first voltage selector 275 selects the second high power voltage Vdd2 to become the high power voltage Vdd. When the first auxiliary power voltage Vadd is the low auxiliary power voltage VL and the second auxiliary power voltage Vass is the high auxiliary power voltage VH, the first voltage selector 275 selects the first high power voltage Vdd1 to become the high power voltage Vdd.

Figure 3:
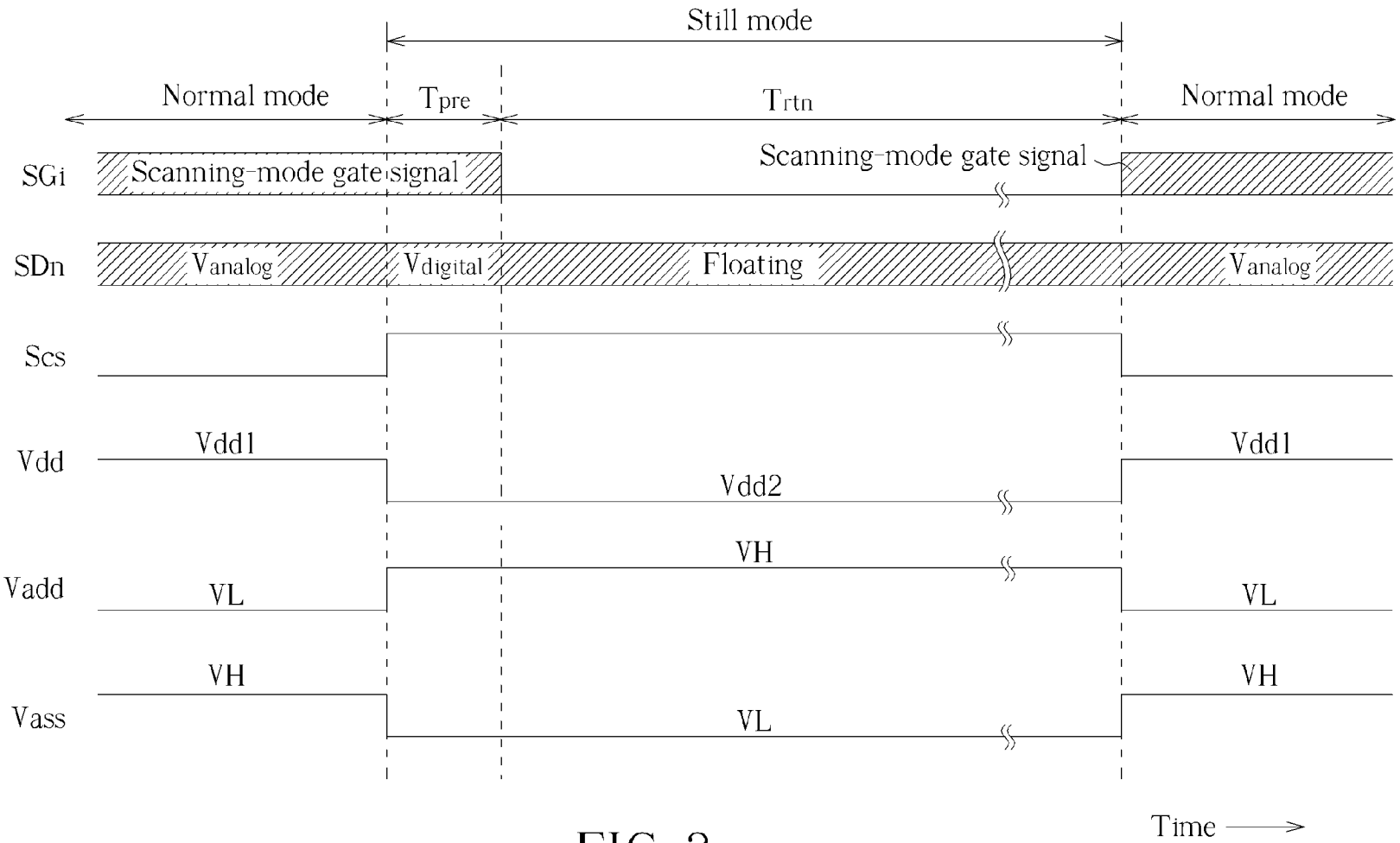
FIG. 3 is a schematic diagram showing related signal waveforms regarding the operation of the organic light emitting display shown in FIG. 2, having time along the abscissa.

FIG. 3 is a schematic diagram showing related signal waveforms regarding the operation of the organic light emitting display 200 shown in FIG. 2, having time along the abscissa. The signal waveforms in FIG. 3, from top to bottom, are the gate signal SGi, the data signal SDn, the selection control signal Scs, the high power voltage Vdd, the first auxiliary power voltage Vadd and the second auxiliary power voltage Vass.

When the organic light emitting display 200 is working in a normal mode, the data signal SDn provided by the data driving circuit 220 is a multi-level analog voltage Vanalog, the gate driving circuit 210 provides the gate signal SGi based on a normal scanning mode, the first transistor 251 inputs the data signal SDn to become the driving voltage Vd according to the gate signal SGi provided under the normal scanning mode. Concurrently, the selection control signal Scs is in a first state so that the first voltage selector 275 selects the first high power voltage Vdd1 to become the high power voltage Vdd, the second voltage selector 280 selects the low auxiliary power voltage VL to become the first auxiliary power voltage Vadd, and the third voltage selector 285 selects the high auxiliary power voltage VH to become the second auxiliary power voltage Vass. That is, while the organic light emitting display 200 is working in the normal mode, the memory unit 255 is disabled, the second transistor 252 controls the magnitude of the driving current Id according to the driving voltage Vd and the first high power voltage Vdd1, and the organic light emitting diode 254 is driven by the driving current Id for generating a light output having multi-level grey scale.

After the organic light emitting display 200 enters a still mode for displaying a still frame, during a preliminary interval Tpre, the data signal SDn provided by the data driving circuit 220 is a bi-level digital voltage Vdigital, the first transistor 251 inputs the bi-level digital voltage Vdigital to become the driving voltage Vd according to the gate signal SGi provided under the normal scanning mode. Concurrently, the selection control signal Scs is in a second state so that the first voltage selector 275 selects the second high power voltage Vdd2 to become the high power voltage Vdd, the second voltage selector 280 selects the high auxiliary power voltage VH to become the first auxiliary power voltage Vadd, and the third voltage selector 285 selects the low auxiliary power voltage VL to become the second auxiliary power voltage Vass. That is, during the preliminary interval Tpre, the memory unit 255 is enabled to perform a voltage retaining operation on the driving voltage Vd, the second transistor 252 controls the magnitude of the driving current Id according to the driving voltage Vd and the second high power voltage Vdd2, and the organic light emitting diode 254 is driven by the driving current Id for generating a light output having bi-level grey scale. Besides, the gate driving circuit 210 is turned off after the bi-level digital voltage Vdigital is inputted to become the driving voltage Vd. Further, the data driving circuit 220 is turned off after the gate driving circuit 210 is turned off and thus the data signal SDn becomes a floating voltage.

During a retaining interval Trtn under the still mode, since the gate driving circuit 210 is turned off, the first transistor 251 holds a turn-off state. Further since the high power voltage Vdd, the first auxiliary power voltage Vadd and the second auxiliary power voltage Vass continue to retain the second high power voltage Vdd2, the high auxiliary power voltage VH and the low auxiliary power voltage VL respectively, the memory unit 255 is continuously enabled for performing the voltage retaining operation on the driving voltage Vd, i.e. for performing a pixel data self-retaining operation to retain the bi-level digital voltage Vdigital furnished in the preliminary interval Tpre. It is noted that, because the voltage swing range of the bi-level digital voltage Vdigital may be different from that of the multi-level analog voltage Vanalog, the levels of the high power voltage Vdd under normal and still mode operations may also different, i.e. using the first high power voltage Vdd1 for normal mode operation and using the second high power voltage Vdd2 for still mode operation as aforementioned.

When the organic light emitting display 200 switches from the still mode to the normal mode, the selection control signal Scs is switched to the first state so that the high power voltage Vdd, the first auxiliary power voltage Vadd and the second auxiliary power voltage Vass are switched to the first high power voltage Vdd1, the low auxiliary power voltage VL and the high auxiliary power voltage VH respectively, and the memory unit 255 is disabled for ceasing the voltage retaining operation. Furthermore, the data driving circuit 220 is turned on for providing the data signal SDn having the multi-level analog voltage Vanalog, the gate driving circuit 210 is turned on for providing the gate signal SGi under the normal scanning mode, and therefore the first transistor 251 is again utilized for inputting the data signal SDn to become the driving voltage Vd according to the gate signal SGi. In summary, while entering a still mode, the organic light emitting display 200 is capable of performing a pixel data self-retaining operation for displaying a still frame, and the gate driving circuit 210 and the data driving circuit 220 can therefore be turned off for significantly reducing the power consumption of displaying the still frame.

Figure 4:
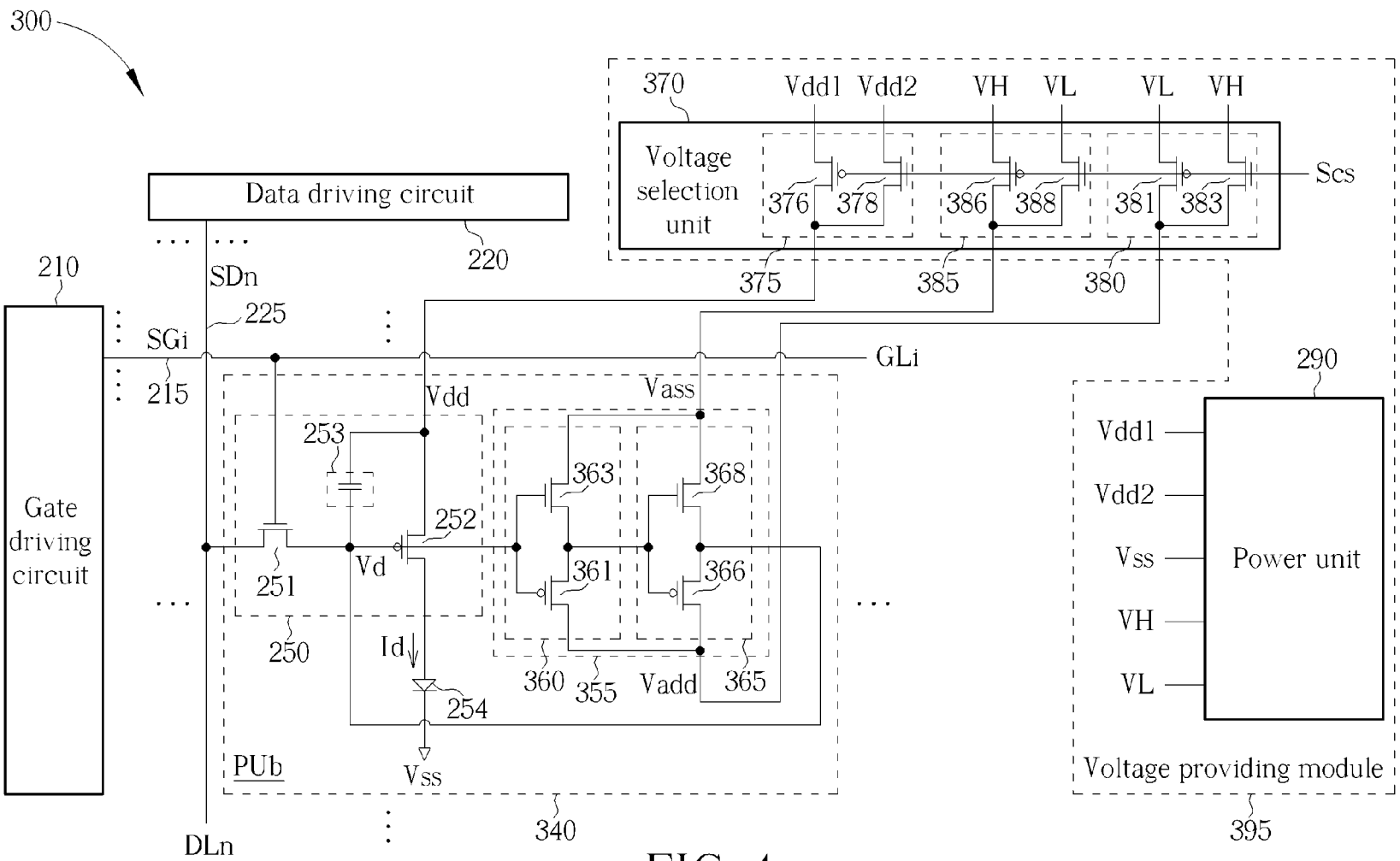
FIG. 4 is a schematic diagram showing the structure of an organic light emitting display in accordance with a second embodiment of the present invention.

FIG. 4 is a schematic diagram showing the structure of an organic light emitting display 300 in accordance with a second embodiment of the present invention. As shown in FIG. 4, the circuit structure of the organic light emitting display 300 is similar to that of the organic light emitting display 200 shown in FIG. 2, differing in that the voltage providing module 295 is replaced with a voltage providing module 395 and the pixel circuits 240 are replaced with a plurality of pixel circuits 340, wherein the pixel circuit PUa is replaced with a pixel circuit PUb. The pixel circuit PUb comprises the current driving unit 250, a memory unit 355 and the organic light emitting diode 254. The voltage providing module 395 comprises the power unit 290 and a voltage selection unit 370. The memory unit 355 comprises a first inverter 360 and a second inverter 365. The voltage selection unit 370 comprises a first voltage selector 375, a second voltage selector 380 and a third voltage selector 385.

The first inverter 360 comprises a first P-type thin film transistor 361 and a first N-type thin film transistor 363. The second inverter 365 comprises a second P-type thin film transistor 366 and a second N-type thin film transistor 368. The first voltage selector 375 comprises a third P-type thin film transistor 376 and a third N-type thin film transistor 378. The second voltage selector 380 comprises a fourth P-type thin film transistor 381 and a fourth N-type thin film transistor 383. The third voltage selector 385 comprises a fifth P-type thin film transistor 386 and a fifth N-type thin film transistor 388.

The first P-type thin film transistor 361 comprises a first end electrically connected to the second voltage selector 380 for receiving a first auxiliary power voltage Vadd, a second end electrically connected to the second inverter 365, and a gate end electrically connected to the second end of the first transistor 251 for receiving the driving voltage Vd. The first N-type thin film transistor 363 comprises a first end electrically connected to the second end of the first P-type thin film transistor 361, a second end electrically connected to the third voltage selector 385 for receiving a second auxiliary power voltage Vass, and a gate end electrically connected to the gate end of the first P-type thin film transistor 361. It is noted that the gate ends of the first P-type thin film transistor 361 and the first N-type thin film transistor 363 are functioning as an input end of the first inverter 360, the second end of the first P-type thin film transistor 361 and the first end of the first N-type thin film transistor 363 are functioning as an output end of the first inverter 360, the first end of the first P-type thin film transistor 361 is functioning as a first power end of the first inverter 360, and the second end of the first N-type thin film transistor 363 is functioning as a second power end of the first inverter 360.

The second P-type thin film transistor 366 comprises a first end electrically connected to the second voltage selector 380 for receiving the first auxiliary power voltage Vadd, a second end electrically connected to the gate end of the first P-type thin film transistor 361, and a gate end electrically connected to the second end of the first P-type thin film transistor 361. The second N-type thin film transistor 368 comprises a first end electrically connected to the second end of the second P-type thin film transistor 366, a second end electrically connected to the third voltage selector 385 for receiving the second auxiliary power voltage Vass, and a gate end electrically connected to the gate end of the second P-type thin film transistor 366. It is noted that the gate ends of the second P-type thin film transistor 366 and the second N-type thin film transistor 368 are functioning as an input end of the second inverter 365, the second end of the second P-type thin film transistor 366 and the first end of the second N-type thin film transistor 368 are functioning as an output end of the second inverter 365, the first end of the second P-type thin film transistor 366 is functioning as a first power end of the second inverter 365, and the second end of the second N-type thin film transistor 368 is functioning as a second power end of the second inverter 368.

The third P-type thin film transistor 376 comprises a first end electrically connected to the power unit 290 for receiving the first high power voltage Vdd1, a second end electrically connected to the first end of the second transistor 252, and a gate end for receiving the selection control signal Scs. The third N-type thin film transistor 378 comprises a first end electrically connected to the power unit 290 for receiving the second high power voltage Vdd2, a second end electrically connected to the second end of the third P-type thin film transistor 376, and a gate end for receiving the selection control signal Scs.

The fourth P-type thin film transistor 381 comprises a first end electrically connected to the power unit 290 for receiving the low auxiliary power voltage VL, a second end electrically connected to the first ends of the first P-type thin film transistor 361 and the second P-type thin film transistor 366, and a gate end for receiving the selection control signal Scs. The fourth N-type thin film transistor 383 comprises a first end electrically connected to the power unit 290 for receiving the high auxiliary power voltage VH, a second end electrically connected to the second end of the fourth P-type thin film transistor 381, and a gate end for receiving the selection control signal Scs.

The fifth P-type thin film transistor 386 comprises a first end electrically connected to the power unit 290 for receiving the high auxiliary power voltage VH, a second end electrically connected to the second ends of the first N-type thin film transistor 363 and the second N-type thin film transistor 368, and a gate end for receiving the selection control signal Scs. The fifth N-type thin film transistor 388 comprises a first end electrically connected to the power unit 290 for receiving the low auxiliary power voltage VL, a second end electrically connected to the second end of the fifth P-type thin film transistor 386, and a gate end for receiving the selection control signal Scs.

The related signal waveforms regarding the operation of the organic light emitting display 300 are substantially identical to the signal waveforms shown in FIG. 3. Therefore, while entering a still mode, the organic light emitting display 300 is also capable of performing a pixel data self-retaining operation for displaying a still frame, and the gate driving circuit 210 and the data driving circuit 220 can therefore be turned off for significantly reducing the power consumption of displaying the still frame.

Figure 5:
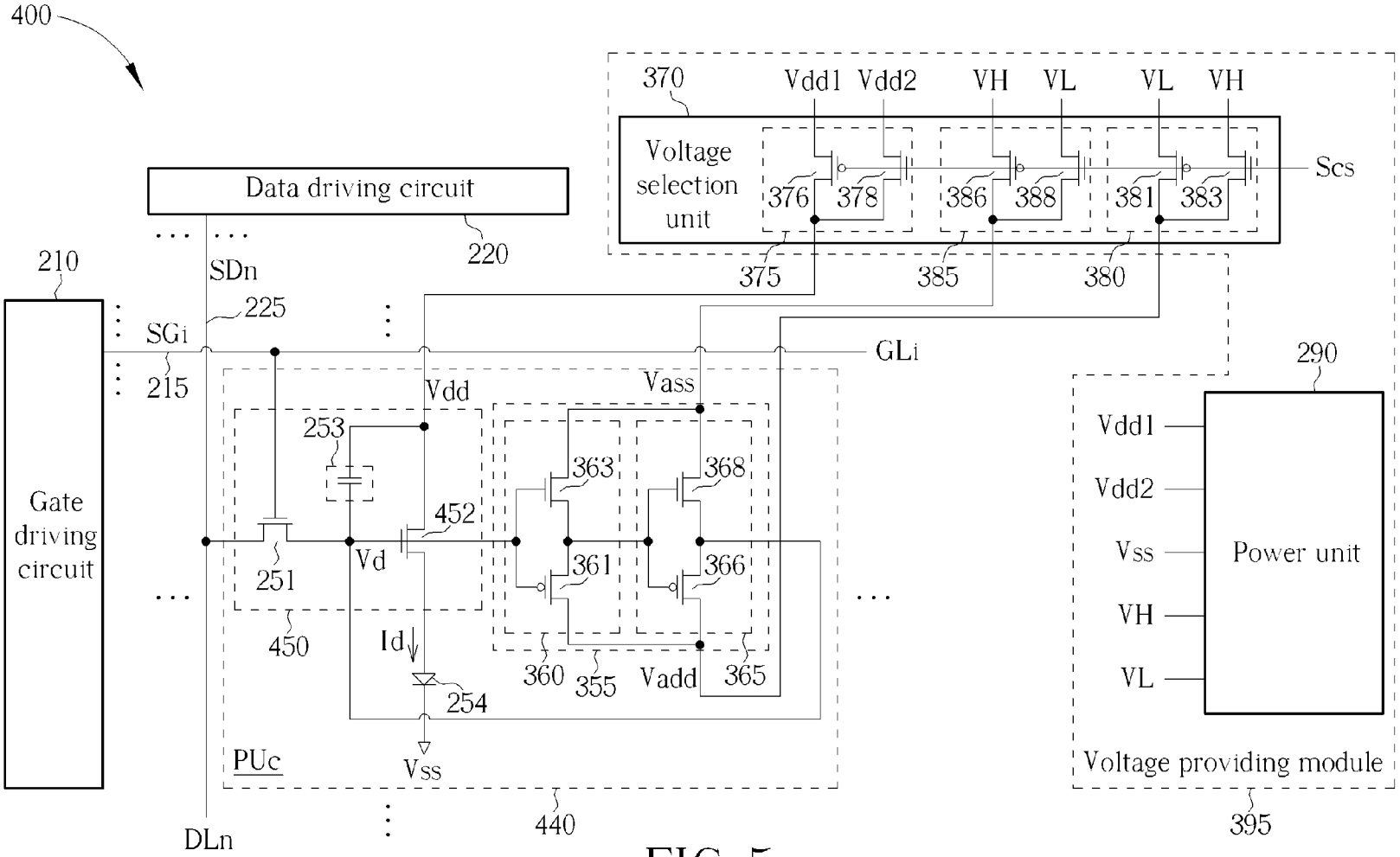
FIG. 5 is a schematic diagram showing the structure of an organic light emitting display in accordance with a third embodiment of the present invention.

FIG. 5 is a schematic diagram showing the structure of an organic light emitting display 400 in accordance with a third embodiment of the present invention. As shown in FIG. 5, the circuit structure of the organic light emitting display 400 is similar to that of the organic light emitting display 300 shown in FIG. 4, differing in that the pixel circuits 340 are replaced with a plurality of pixel circuits 440, wherein the pixel circuit PUb is replaced with a pixel circuit PUc. The pixel circuit PUc comprises a current driving unit 450, the memory unit 355 and the organic light emitting diode 254. The current driving unit 450 comprises the first transistor 251, a second transistor 452 and the storage capacitor 253.

The second transistor 452 can be an N-type thin film transistor having a first end electrically connected to the second end of the third P-type thin film transistor 376 for receiving the high power voltage Vdd, a second end electrically connected to the anode of the organic light emitting diode 254, and a gate end electrically connected to the second end of the first transistor 251. The related signal waveforms regarding the operation of the organic light emitting display 400 are substantially identical to the signal waveforms shown in FIG. 3. Therefore, while entering a still mode, the organic light emitting display 400 is also capable of performing a pixel data self-retaining operation for displaying a still frame, and the gate driving circuit 210 and the data driving circuit 220 can therefore be turned off for significantly reducing the power consumption of displaying the still frame.

Figure 6:
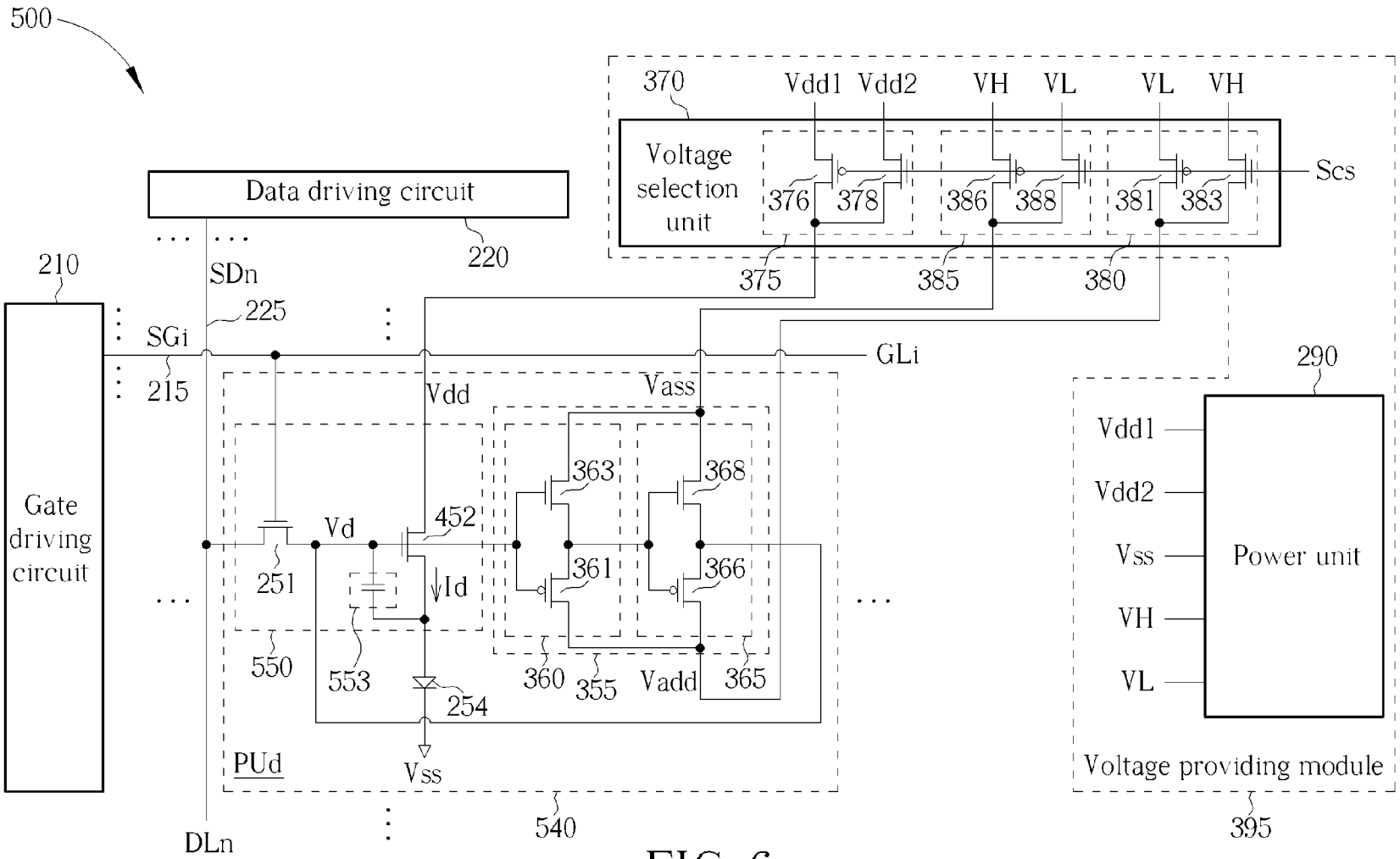
FIG. 6 is a schematic diagram showing the structure of an organic light emitting display in accordance with a fourth embodiment of the present invention.

FIG. 6 is a schematic diagram showing the structure of an organic light emitting display 500 in accordance with a fourth embodiment of the present invention. As shown in FIG. 6, the circuit structure of the organic light emitting display 500 is similar to that of the organic light emitting display 400 shown in FIG. 5, differing in that the pixel circuits 440 are replaced with a plurality of pixel circuits 540, wherein the pixel circuit PUc is replaced with a pixel circuit PUd. The pixel circuit PUd comprises a current driving unit 550, the memory unit 355 and the organic light emitting diode 254. The current driving unit 550 comprises the first transistor 251, the second transistor 452 and a storage capacitor 553. The storage capacitor 553 is electrically connected between the gate and second ends of the second transistor 452. The related signal waveforms regarding the operation of the organic light emitting display 500 are substantially identical to the signal waveforms shown in FIG. 3. Therefore, while entering a still mode, the organic light emitting display 500 is also capable of performing a pixel data self-retaining operation for displaying a still frame, and the gate driving circuit 210 and the data driving circuit 220 can therefore be turned off for significantly reducing the power consumption of displaying the still frame.

Figure 7:
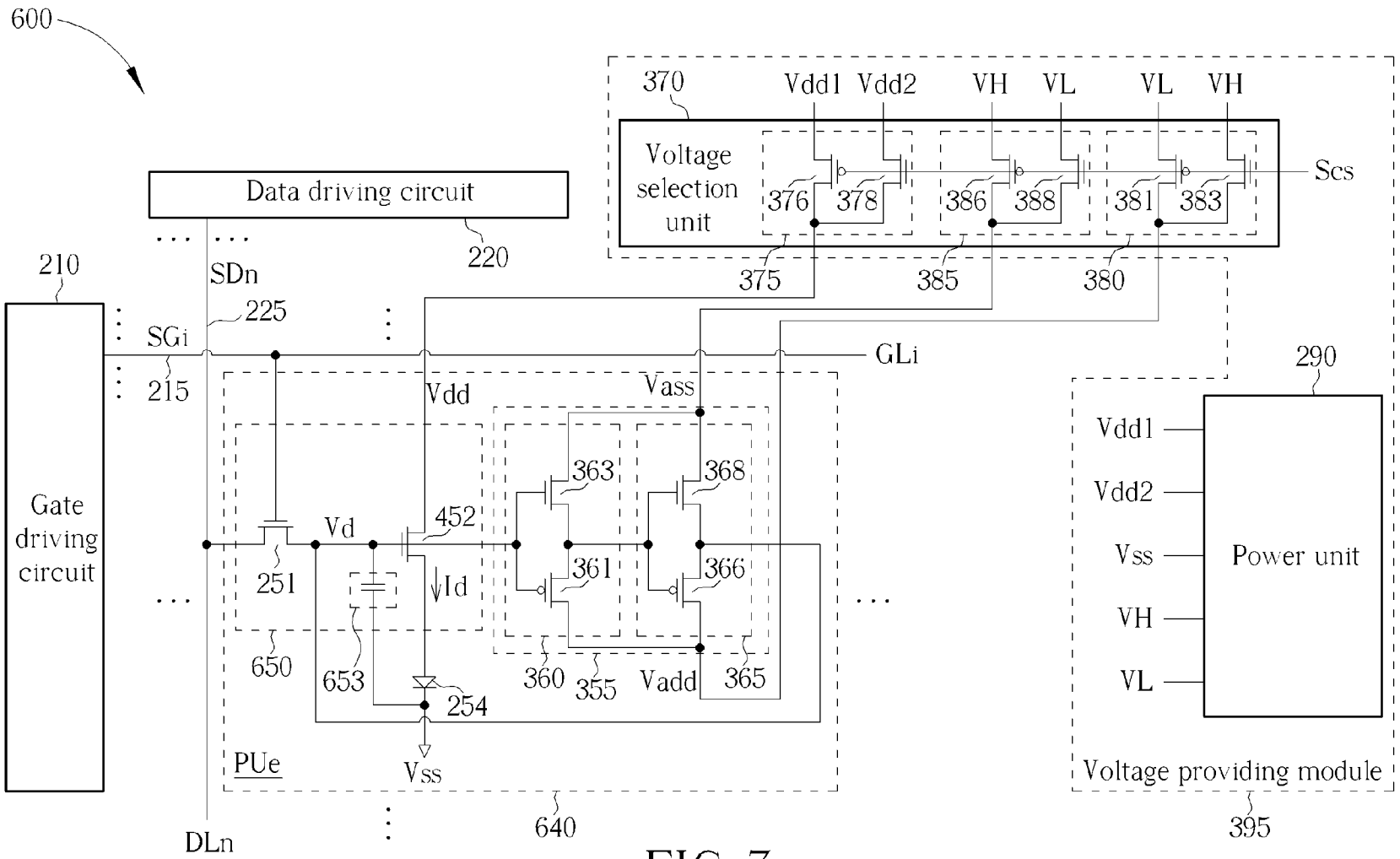
FIG. 7 is a schematic diagram showing the structure of an organic light emitting display in accordance with a fifth embodiment of the present invention.

FIG. 7 is a schematic diagram showing the structure of an organic light emitting display 600 in accordance with a fifth embodiment of the present invention. As shown in FIG. 7, the circuit structure of the organic light emitting display 600 is similar to that of the organic light emitting display 400 shown in FIG. 5, differing in that the pixel circuits 440 are replaced with a plurality of pixel circuits 640, wherein the pixel circuit PUc is replaced with a pixel circuit PUe. The pixel circuit PUe comprises a current driving unit 650, the memory unit 355 and the organic light emitting diode 254. The current driving unit 650 comprises the first transistor 251, the second transistor 452 and a storage capacitor 653. The storage capacitor 653 is electrically connected between the gate end of the second transistor 452 and the cathode of the organic light emitting diode 254. The related signal waveforms regarding the operation of the organic light emitting display 600 are substantially identical to the signal waveforms shown in FIG. 3. Therefore, while entering a still mode, the organic light emitting display 600 is also capable of performing a pixel data self-retaining operation for displaying a still frame, and the gate driving circuit 210 and the data driving circuit 220 can therefore be turned off for significantly reducing the power consumption of displaying the still frame.

Figure 8:
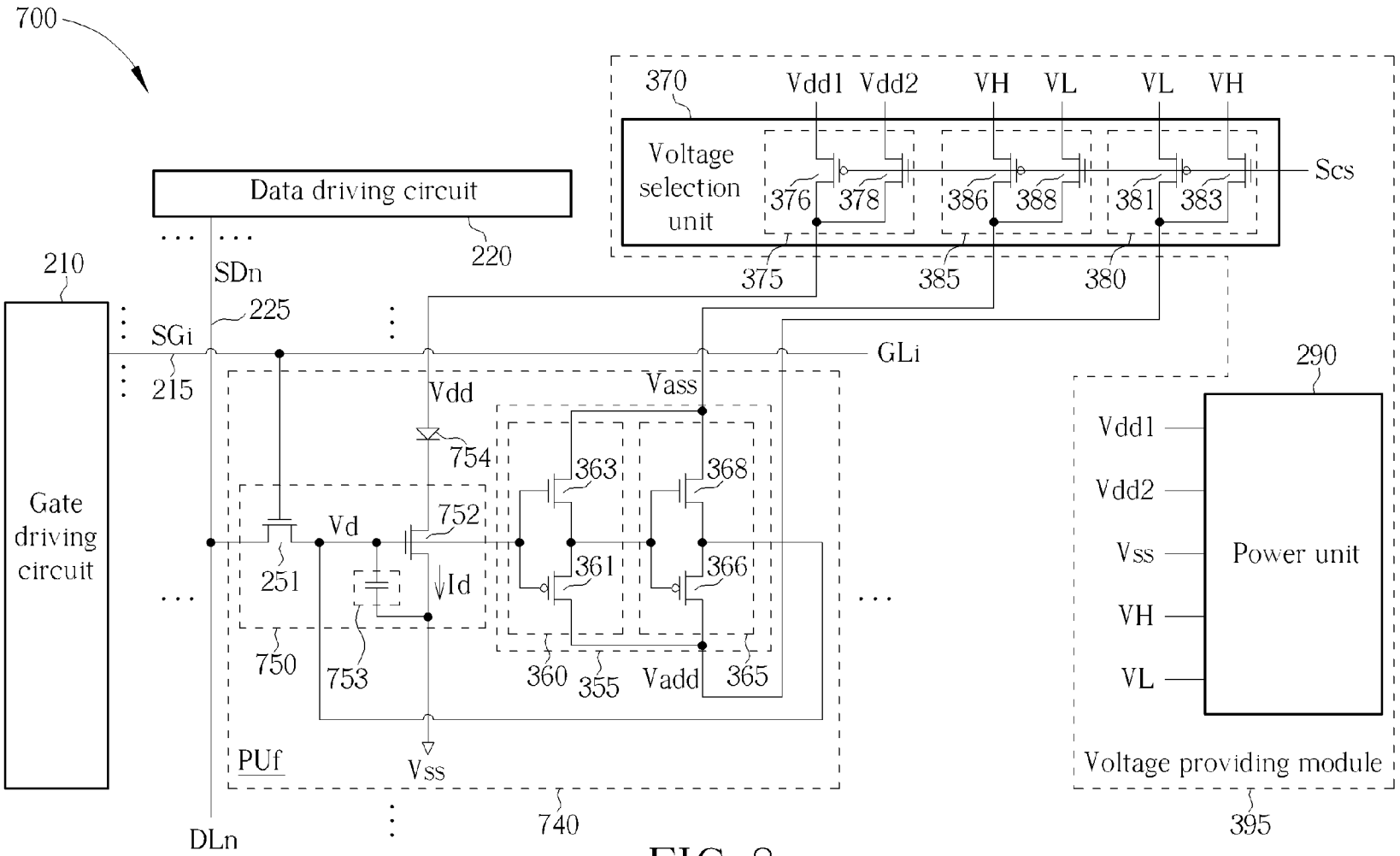
FIG. 8 is a schematic diagram showing the structure of an organic light emitting display in accordance with a sixth embodiment of the present invention.

FIG. 8 is a schematic diagram showing the structure of an organic light emitting display 700 in accordance with a sixth embodiment of the present invention. As shown in FIG. 8, the circuit structure of the organic light emitting display 700 is similar to that of the organic light emitting display 500 shown in FIG. 6, differing in that the pixel circuits 540 are replaced with a plurality of pixel circuits 740, wherein the pixel circuit PUd is replaced with a pixel circuit PUf. The pixel circuit PUf comprises a current driving unit 750, the memory unit 355 and an organic light emitting diode 754. The current driving unit 750 comprises the first transistor 251, a second transistor 752 and a storage capacitor 753. The organic light emitting diode 754 comprises an anode electrically connected to the second end of the third P-type thin film transistor 376 for receiving the high power voltage Vdd and a cathode electrically connected to the second transistor 752. The second transistor 752 comprises a first end electrically connected to the cathode of the organic light emitting diode 754, a second end electrically connected to the power unit 290 for receiving the low power voltage Vss, and a gate end electrically connected to the second end of the first transistor 251. The second transistor 752 can be a P-type thin film transistor or an N-type thin film transistor. The storage capacitor 753 is electrically connected between the gate and second ends of the second transistor 752. The related signal waveforms regarding the operation of the organic light emitting display 700 are substantially identical to the signal waveforms shown in FIG. 3. Therefore, while entering a still mode, the organic light emitting display 700 is also capable of performing a pixel data self-retaining operation for displaying a still frame, and the gate driving circuit 210 and the data driving circuit 220 can therefore be turned off for significantly reducing the power consumption of displaying the still frame.

Figure 9:
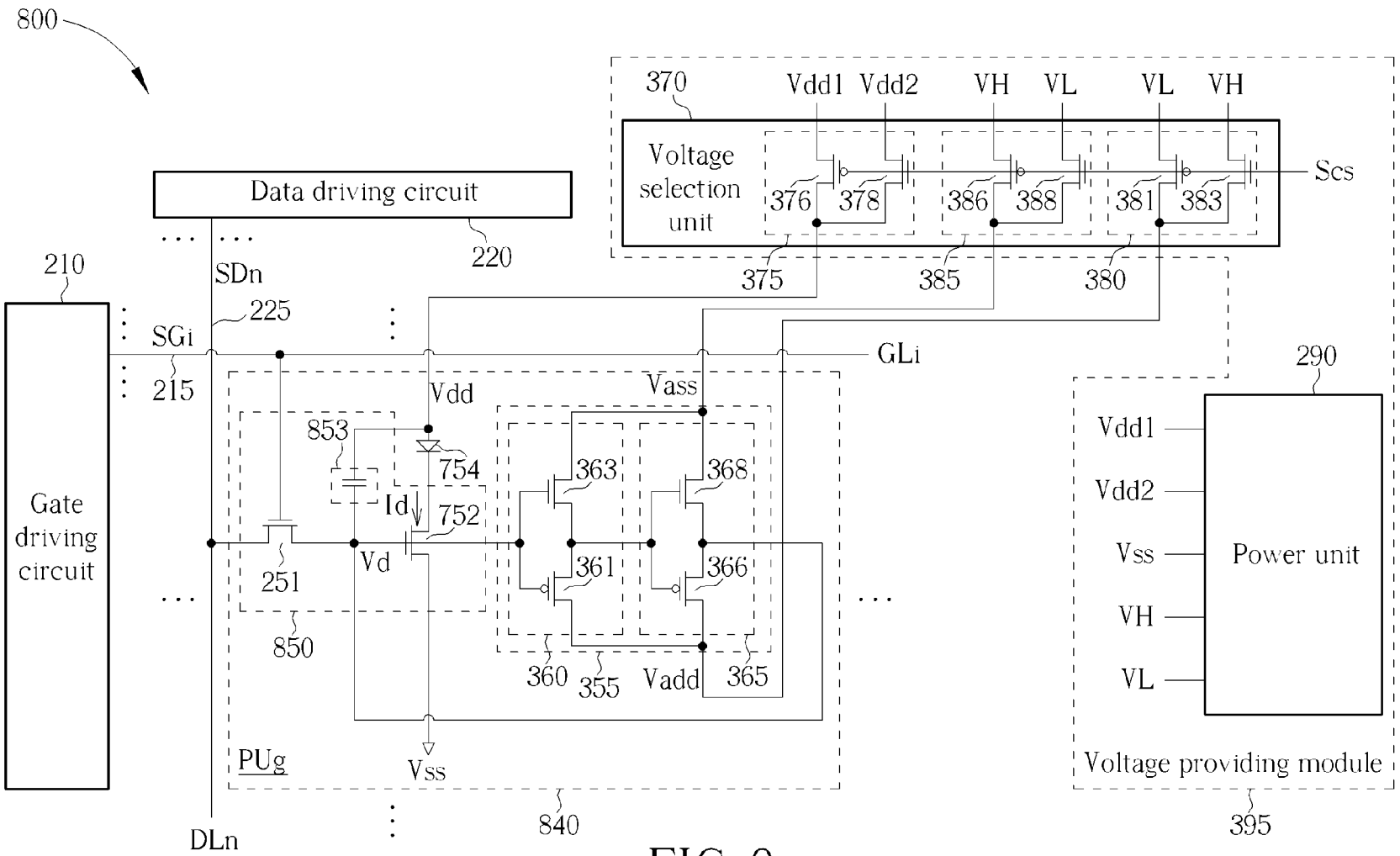
FIG. 9 is a schematic diagram showing the structure of an organic light emitting display in accordance with a seventh embodiment of the present invention.

FIG. 9 is a schematic diagram showing the structure of an organic light emitting display 800 in accordance with a seventh embodiment of the present invention. As shown in FIG. 9, the circuit structure of the organic light emitting display 800 is similar to that of the organic light emitting display 700 shown in FIG. 8, differing in that the pixel circuits 740 are replaced with a plurality of pixel circuits 840, wherein the pixel circuit PUf is replaced with a pixel circuit PUg. The pixel circuit PUg comprises a current driving unit 850, the memory unit 355 and the organic light emitting diode 754. The current driving unit 850 comprises the first transistor 251, the second transistor 752 and a storage capacitor 853. The storage capacitor 853 is electrically connected between the gate end of the second transistor 752 and the anode of the organic light emitting diode 754. The related signal waveforms regarding the operation of the organic light emitting display 800 are substantially identical to the signal waveforms shown in FIG. 3. Therefore, while entering a still mode, the organic light emitting display 800 is also capable of performing a pixel data self-retaining operation for displaying a still frame, and the gate driving circuit 210 and the data driving circuit 220 can therefore be turned off for significantly reducing the power consumption of displaying the still frame.

Figure 10:
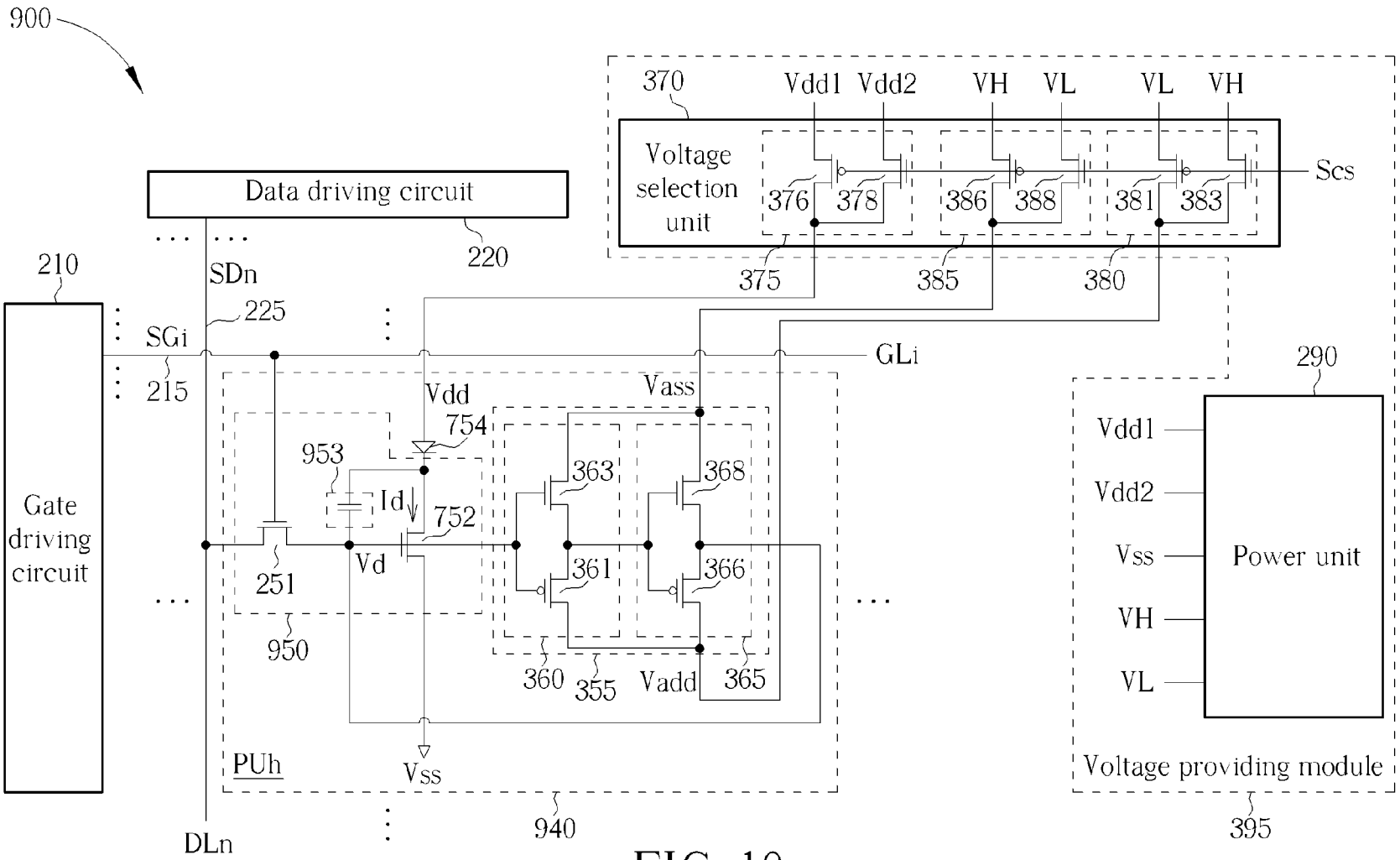
FIG. 10 is a schematic diagram showing the structure of an organic light emitting display in accordance with an eighth embodiment of the present invention.

FIG. 10 is a schematic diagram showing the structure of an organic light emitting display 900 in accordance with an eighth embodiment of the present invention. As shown in FIG. 10, the circuit structure of the organic light emitting display 900 is similar to that of the organic light emitting display 700 shown in FIG. 8, differing in that the pixel circuits 740 are replaced with a plurality of pixel circuits 940, wherein the pixel circuit PUf is replaced with a pixel circuit PUh. The pixel circuit PUh comprises a current driving unit 950, the memory unit 355 and the organic light emitting diode 754. The current driving unit 950 comprises the first transistor 251, the second transistor 752 and a storage capacitor 953. The storage capacitor 953 is electrically connected between the first and gate ends of the second transistor 752. The related signal waveforms regarding the operation of the organic light emitting display 900 are substantially identical to the signal waveforms shown in FIG. 3. Therefore, while entering a still mode, the organic light emitting display 900 is also capable of performing a pixel data self-retaining operation for displaying a still frame, and the gate driving circuit 210 and the data driving circuit 220 can therefore be turned off for significantly reducing the power consumption of displaying the still frame.

In conclusion, while entering a still mode, the organic light emitting display of the present invention is capable of performing a pixel data self-retaining operation for displaying a still frame, and the gate driving circuit and the data driving circuit thereof can be turned off for significantly reducing the power consumption of displaying the still frame.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. An organic light emitting display, comprising:

a gate driving circuit for providing a gate signal;

a data driving circuit for providing a data signal;

a gate line, electrically connected to the gate driving circuit, for delivering the gate signal;

a data line, electrically connected to the data driving circuit, for delivering the data signal;

a current driving unit, electrically connected to the gate line and the data line, for generating a driving voltage according to the gate signal and the data signal, and for providing a driving current according to the driving voltage and a high power voltage;

an organic light emitting diode, electrically connected to the current driving unit, for generating a light output according to the driving current;

a memory unit, electrically connected to the current driving unit, for performing a voltage retaining operation on the driving voltage according to a first auxiliary power voltage and a second auxiliary power voltage; and a voltage providing module, electrically connected to the current driving unit and the memory unit, for providing the high power voltage, the first auxiliary power voltage and the second auxiliary power voltage;

wherein the memory unit is enabled to perform the voltage retaining operation when the first auxiliary power voltage is a high auxiliary power voltage and the second auxiliary power voltage is a low auxiliary power voltage, and the memory unit is disabled for ceasing the voltage retaining operation when the first auxiliary power voltage is the low auxiliary power voltage and the second auxiliary power voltage is the high auxiliary power voltage;

wherein the voltage providing module comprises:

a power unit for providing a first high power voltage, a second high power voltage lower than the first high power voltage, the high auxiliary power voltage and the low auxiliary power voltage;

a first voltage selector, electrically connected to the power unit and the current driving unit, for selecting either the first high power voltage or the second high power voltage to become the high power voltage;

a second voltage selector, electrically connected to the power unit and the memory unit, for selecting either the high auxiliary power voltage or the low auxiliary power voltage to become the first auxiliary power voltage; and a third voltage selector, electrically connected to the power unit and the memory unit, for selecting either the low auxiliary power voltage or the high auxiliary power voltage to become the second auxiliary power voltage;

wherein the first voltage selector selects the second high power voltage to become the high power voltage when the first auxiliary power voltage is the high auxiliary power voltage and the second auxiliary power voltage is the low auxiliary power voltage, and the first voltage selector selects the first high bower voltage to become the high power voltage when the first auxiliary power voltage is the low auxiliary power voltage and the second auxiliary power voltage is the high auxiliary power voltage.

2. The organic light emitting display of claim 1, wherein the memory unit comprises:

a first inverter comprising an input end electrically connected to the current driving unit for receiving the driving voltage, a first power end electrically connected to the voltage providing module for receiving the first auxiliary power voltage, a second power end electrically connected to the voltage providing module for receiving the second auxiliary power voltage, and an output end; and a second inverter comprising an input end electrically connected to the output end of the first inverter, a first power end electrically connected to the voltage providing module for receiving the first auxiliary power voltage, a second power end electrically connected to the voltage providing module for receiving the second auxiliary power voltage, and an output end electrically connected to the input end of the first inverter.

3. The organic light emitting display of claim 2, wherein:

the first inverter comprises:

a first P-type thin film transistor comprising a first end electrically connected to the voltage providing module for receiving the first auxiliary power voltage, a second end electrically connected to the input end of the second inverter, and a gate end electrically connected to the current driving unit for receiving the driving voltage; and a first N-type thin film transistor comprising a first end electrically connected to the second end of the first P-type thin film transistor, a second end electrically connected to the voltage providing module for receiving the second auxiliary power voltage, and a gate end electrically connected to the gate end of the first P-type thin film transistor; and the second inverter comprises:

a second P-type thin film transistor comprising a first end electrically connected to the voltage providing module for receiving the first auxiliary power voltage, a second end electrically connected to the gate end of the first P-type thin film transistor, and a gate end electrically connected to the second end of the first P-type thin film transistor; and a second N-type thin film transistor comprising a first end electrically connected to the second end of the second P-type thin film transistor, a second end electrically connected to the voltage providing module for receiving the second auxiliary power voltage, and a gate end electrically connected to the gate end of the second P-type thin film transistor.

4. The organic light emitting display of claim 1, wherein the first voltage selector comprises:

a P-type thin film transistor comprising a first end electrically connected to the power unit for receiving the first high power voltage, a second end electrically connected to the current driving unit, and a gate end for receiving a selection control signal; and an N-type thin film transistor comprising a first end electrically connected to the power unit for receiving the second high power voltage, a second end electrically connected to the second end of the P-type thin film transistor, and a gate end for receiving the selection control signal.

5. The organic light emitting display of claim 1, wherein the second voltage selector comprises:

a P-type thin film transistor comprising a first end electrically connected to the power unit for receiving the low auxiliary power voltage, a second end electrically connected to the memory unit, and a gate end for receiving a selection control signal; and an N-type thin film transistor comprising a first end electrically connected to the power unit for receiving the high auxiliary power voltage, a second end electrically connected to the second end of the P-type thin film transistor, and a gate end for receiving the selection control signal.

6. The organic light emitting display of claim 1, wherein the third voltage selector comprises:

a P-type thin film transistor comprising a first end electrically connected to the power unit for receiving the high auxiliary power voltage, a second end electrically connected to the memory unit, and a gate end for receiving a selection control signal; and an N-type thin film transistor comprising a first end electrically connected to the power unit for receiving the low auxiliary power voltage, a second end electrically connected to the second end of the P-type thin film transistor, and a gate end for receiving the selection control signal.

7. The organic light emitting display of claim 1, wherein:

the organic light emitting diode comprises an anode electrically connected to the current driving unit and a cathode for receiving a low power voltage;

the current driving unit comprises:

a first transistor comprising a first end electrically connected to the data line for receiving the data signal, a second end electrically connected to the memory unit, and a gate end electrically connected to the gate line for receiving the gate signal;

a second transistor comprising a first end for receiving the high power voltage, a second end electrically connected to the anode of the organic light emitting diode, and a gate end electrically connected to the second end of the first transistor; and a storage capacitor comprising a first end electrically connected to the gate end of the second transistor and a second end electrically connected to the first end of the second transistor, the second end of the second transistor or the cathode of the organic light emitting diode; and the voltage providing module is further employed to provide the low power voltage.

8. The organic light emitting display of claim 7, wherein the second transistor is a P-type thin film transistor or an N-type thin film transistor.

9. The organic light emitting display of claim 7, wherein the first transistor is a P-type thin film transistor or an N-type thin film transistor.

10. The organic light emitting display of claim 1, wherein:

the organic light emitting diode comprises an anode for receiving the high power voltage and a cathode electrically connected to the current driving unit;

the current driving unit comprises:

a first transistor comprising a first end electrically connected to the data line for receiving the data signal, a second end electrically connected to the memory unit, and a gate end electrically connected to the gate line for receiving the gate signal;

a second transistor comprising a first end electrically connected to the cathode of the organic light emitting diode, a second end for receiving a low power voltage, and a gate end electrically connected to the second end of the first transistor; and a storage capacitor comprising a first end electrically connected to the gate end of the second transistor and a second end electrically connected to the first end of the second transistor, the second end of the second transistor or the anode of the organic light emitting diode; and the voltage providing module is further employed to provide the low power voltage.

11. The organic light emitting display of claim 10, wherein the second transistor is a P-type thin film transistor or an N-type thin film transistor.

12. The organic light emitting display of claim 10, wherein the first transistor is a P-type thin film transistor or an N-type thin film transistor.

13. An organic light emitting display, comprising:

a gate driving circuit for providing a gate signal;

a data driving circuit for providing a data signal;

a gate line, electrically connected to the gate driving circuit, for delivering the gate signal;

a data line, electrically connected to the data driving circuit, for delivering the data signal;

a current driving unit, electrically connected to the gate line and the data line, for generating a driving voltage according to the gate signal and the data signal, and for providing a driving current according to the driving voltage and a high power voltage;

an organic light emitting diode, electrically connected to the current driving unit, for generating a light output according to the driving current;

a first inverter comprising an input end electrically connected to the current driving unit for receiving the driving voltage, a first power end for receiving a first auxiliary power voltage, a second power end for receiving a second auxiliary power voltage, and an output end;

a second inverter comprising an input end electrically connected to the output end of the first inverter, a first power end for receiving the first auxiliary power voltage, a second power end for receiving the second auxiliary power voltage, and an output end electrically connected to the input end of the first inverter; and a voltage providing module, electrically connected to the current driving unit, the first inverter and the second inverter, for providing the high power voltage, the first auxiliary power voltage and the second auxiliary power voltage;

wherein the first and second inverters are enabled to perform a voltage retaining operation on the driving voltage when the first auxiliary power voltage is a high auxiliary power voltage and the second auxiliary power voltage is a low auxiliary power voltage, and the first and second inverters are disabled for ceasing the voltage retaining operation when the first auxiliary power voltage is the low auxiliary power voltage and the second auxiliary power voltage is the high auxiliary power voltage;

wherein the voltage providing module comprises:

a power unit for providing a first high power voltage, a second high power voltage lower than the first high power voltage, the high auxiliary power voltage and the low auxiliary power voltage;

a first voltage selector, electrically connected to the power unit and the current driving unit, for selecting either the first high power voltage or the second high power voltage to become the high power voltage;

a second voltage selector, electrically connected to the power unit, the first inverter and the second inverter, for selecting either the high auxiliary power voltage or the low auxiliary power voltage to become the first auxiliary power voltage; and a third voltage selector, electrically connected to the power unit, the first inverter and the second inverter, for selecting either the low auxiliary power voltage or the high auxiliary power voltage to become the second auxiliary power voltage;

wherein the first voltage selector selects the second high power voltage to become the high power voltage when the first auxiliary power voltage is the high auxiliary power voltage and the second auxiliary power voltage is the low auxiliary power voltage, and the first voltage selector selects the first high bower voltage to become the high power voltage when the first auxiliary power voltage is the low auxiliary power voltage and the second auxiliary power voltage is the high auxiliary power voltage.

14. The organic light emitting display of claim 13, wherein:

the first inverter comprises:

a first P-type thin film transistor comprising a first end electrically connected to the voltage providing module for receiving the first auxiliary power voltage, a second end electrically connected to the input end of the second inverter, and a gate end electrically connected to the current driving unit for receiving the driving voltage; and a first N-type thin film transistor comprising a first end electrically connected to the second end of the first P-type thin film transistor, a second end electrically connected to the voltage providing module for receiving the second auxiliary power voltage, and a gate end electrically connected to the gate end of the first P-type thin film transistor; and the second inverter comprises:

a second P-type thin film transistor comprising a first end electrically connected to the voltage providing module for receiving the first auxiliary power voltage, a second end electrically connected to the gate end of the first P-type thin film transistor, and a gate end electrically connected to the second end of the first P-type thin film transistor; and a second N-type thin film transistor comprising a first end electrically connected to the second end of the second P-type thin film transistor, a second end electrically connected to the voltage providing module for receiving the second auxiliary power voltage, and a gate end electrically connected to the gate end of the second P-type thin film transistor.

15. The organic light emitting display of claim 13, wherein the first voltage selector comprises:

a P-type thin film transistor comprising a first end electrically connected to the power unit for receiving the first high power voltage, a second end electrically connected to the current driving unit, and a gate end for receiving a selection control signal; and an N-type thin film transistor comprising a first end electrically connected to the power unit for receiving the second high power voltage, a second end electrically connected to the second end of the P-type thin film transistor, and a gate end for receiving the selection control signal.

16. The organic light emitting display of claim 13, wherein the second voltage selector comprises:

a P-type thin film transistor comprising a first end electrically connected to the power unit for receiving the low auxiliary power voltage, a second end electrically connected to the first and second inverters, and a gate end for receiving a selection control signal; and an N-type thin film transistor comprising a first end electrically connected to the power unit for receiving the high auxiliary power voltage, a second end electrically connected to the second end of the P-type thin film transistor, and a gate end for receiving the selection control signal.

17. The organic light emitting display of claim 13, wherein the third voltage selector comprises:

a P-type thin film transistor comprising a first end electrically connected to the power unit for receiving the high auxiliary power voltage, a second end electrically connected to the first and second inverters, and a gate end for receiving a selection control signal; and an N-type thin film transistor comprising a first end electrically connected to the power unit for receiving the low auxiliary power voltage, a second end electrically connected to the second end of the P-type thin film transistor, and a gate end for receiving the selection control signal.

18. The organic light emitting display of claim 13, wherein:

the organic light emitting diode comprises an anode electrically connected to the current driving unit and a cathode for receiving a low power voltage;

the current driving unit comprises:

a first transistor comprising a first end electrically connected to the data line for receiving the data signal, a second end electrically connected to the first and second inverters, and a gate end electrically connected to the gate line for receiving the gate signal;

a second transistor comprising a first end for receiving the high power voltage, a second end electrically connected to the anode of the organic light emitting diode, and a gate end electrically connected to the second end of the first transistor; and a storage capacitor comprising a first end electrically connected to the gate end of the second transistor and a second end electrically connected to the first end of the second transistor, the second end of the second transistor or the cathode of the organic light emitting diode; and the voltage providing module is further employed to provide the low power voltage.

19. The organic light emitting display of claim 13, wherein:

the organic light emitting diode comprises an anode for receiving the high power voltage and a cathode electrically connected to the current driving unit;

the current driving unit comprises:

a first transistor comprising a first end electrically connected to the data line for receiving the data signal, a second end electrically connected to the first and second inverters, and a gate end electrically connected to the gate line for receiving the gate signal;

a second transistor comprising a first end electrically connected to the cathode of the organic light emitting diode, a second end for receiving a low power voltage, and a gate end electrically connected to the second end of the first transistor; and a storage capacitor comprising a first end electrically connected to the gate end of the second transistor and a second end electrically connected to the first end of the second transistor, the second end of the second transistor or the anode of the organic light emitting diode; and the voltage providing module is further employed to provide the low power voltage.

* * * * *